US007503829B2

(12) United States Patent
Cory, Jr.

(10) Patent No.: US 7,503,829 B2
(45) Date of Patent: Mar. 17, 2009

(54) HAND-HELD SELF-DEFENSE DEVICE

(76) Inventor: Charles F. Cory, Jr., 16782 Hale Ave., Suite B., Irvine, CA (US) 92606

( * ) Notice: Subject to any disclaimer, the term of this patent is extended or adjusted under 35 U.S.C. 154(b) by 722 days.

(21) Appl. No.: 10/695,683

(22) Filed: Oct. 29, 2003

(65) Prior Publication Data

US 2005/0101389 A1 May 12, 2005

(51) Int. Cl.
*A63H 33/30* (2006.01)

(52) U.S. Cl. ..... 446/473; 30/143; 70/456 R; 206/37.1; 24/3.6

(58) Field of Classification Search ..... 30/153, 30/155, 159, 291, 294, 295, 298, 314; 70/456 R–459; D3/207–212; 206/37.1, 38.1; 24/3.6; 446/473
See application file for complete search history.

(56) References Cited

U.S. PATENT DOCUMENTS

| | | | | |
|---|---|---|---|---|
| 2,099,447 | A | 11/1937 | Matsuyama | |
| D205,456 | S | 8/1966 | Combs | |
| 3,812,583 | A * | 5/1974 | Breglia | 30/164.9 |
| 3,865,370 | A * | 2/1975 | Rogers | 30/165 |
| 4,034,982 | A | 7/1977 | Rupprecht et al. | |
| 4,283,854 | A | 8/1981 | Austin | |
| 4,546,510 | A * | 10/1985 | Harrison | 7/145 |
| D357,051 | S | 4/1995 | Strenkowski | |
| 5,454,565 | A | 10/1995 | Ramirez | |
| 5,509,708 | A * | 4/1996 | Nathan | 294/141 |
| 5,588,214 | A * | 12/1996 | Nelson | 30/368 |
| 5,829,643 | A | 11/1998 | Isabella | |
| 5,863,251 | A | 1/1999 | Fusco | |
| 6,658,743 | B2 * | 12/2003 | Dudley et al. | 30/314 |
| D503,451 | S * | 3/2005 | Tal | D22/117 |
| 2003/0109315 | A1 | 6/2003 | Bunting | |

FOREIGN PATENT DOCUMENTS

EP 484891 A2 * 5/1992

OTHER PUBLICATIONS

Worden, Kelly S. The Travel Wrench Key Ring Training Manual. pp. 1-3, 8-18, date unknown.

* cited by examiner

*Primary Examiner*—Eugene Kim
*Assistant Examiner*—Urszula M Cegielnik
(74) *Attorney, Agent, or Firm*—Knobbe Martens Olson & Bear LLP

(57) ABSTRACT

A personal defense device comprising an elongated shaft that is adapted for grasping thereof by a user's hand. One embodiment further comprises an opening on one end through which the forefinger in placed for stability, comfort, and security. Another embodiment comprises one or more protrusions at the opposite end of the opening that may be used for hooking or striking.

36 Claims, 3 Drawing Sheets

HAND-HELD SELF-DEFENSE DEVICE

BACKGROUND OF THE INVENTION

1. Field of the Invention

This invention, in one embodiment, relates to a personal defense device. Specifically, the defense device is intended to disable an assailant while reducing the risk of lethal injury. In another embodiment, the device also functions as a key chain, permitting the carrier to have immediate access to the device.

2. Description of the Related Art

Crime continues to be one of the greatest problems in our society. Locally, we struggle to reduce crime by installing alarm and surveillance systems, supporting public awareness programs and public services, and exercising increased vigilance. Nationally, the government has attempted to increase public safety by implementing various restrictions in public areas. While these national restrictions are intended to increase the general safety of the public, the restrictions may reduce the ability of individuals to defend themselves against assailants near public areas. For example, increased security of an airport may increase the safety of passenger aircraft. However, the restrictions may also reduce the ability of individuals to defend themselves while in the airport parking lot, while in the airport restroom, or while waiting for a shuttle or taxi.

Therefore, it is desirable to have a defense device that may be designed to fit a variety of sizes, ranging from small children to full-sized adults. The device should also be designed to pass the security regulations implemented in public buildings, amusement parks, and public transportation, particularly passenger aircraft.

SUMMARY OF THE INVENTION

An exemplifying embodiment of the invention comprises an elongated shaft formed to fit in the user's palm. In one embodiment, the elongated shaft comprises a proximal and distal end, and a forward finger-receiving side and a rearward palm-receiving side. In one embodiment, the proximal end comprises an opening, the opening being sized and configured to accommodate placement of a forefinger of a user through the opening. In a further embodiment, the distal end comprises one or more protrusions that constitute impact elements. When the device is used, the forefinger is placed through the opening and the one or more protrusions extend at least distally from the user's hand.

One method of using the personal defense device comprises providing a defense device with an elongated shaft, the elongated shaft having a proximal end, a distal end, a forward side, and a rearward side; an opening on the proximal end that is sized and configured to accommodate placement of a forefinger of a user through the opening; a palm-receiving surface on the rearward side; a finger-receiving surface on the forward side; and a protrusion extending distally of the device. The method further comprises inserting a forefinger of the user through the opening, placing the palm-receiving surface on the palm of the user, and placing the fingers on the finger-receiving surface. When the device is used in this manner, the protrusion extends distally of the user's hand.

BRIEF DESCRIPTION OF THE DRAWINGS

The features of the present invention which are believed to be novel are set forth with particularity in the claims. The invention, together with further objects and advantages thereof, may best be understood by making reference to the following description taken in conjunction with the accompanying drawings, in the figures of which like referenced numerals identify the identical elements, and wherein:

DETAILED DESCRIPTION OF THE PREFERRED EMBODIMENT

Figure 1:
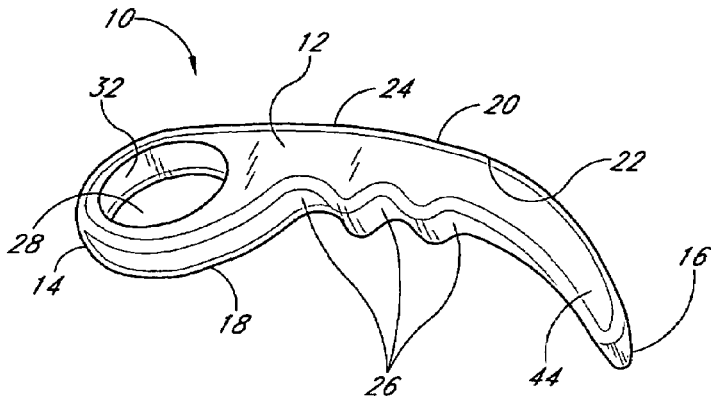
FIG. 1 is a perspective view of one embodiment of the defense device.
Figure 5:
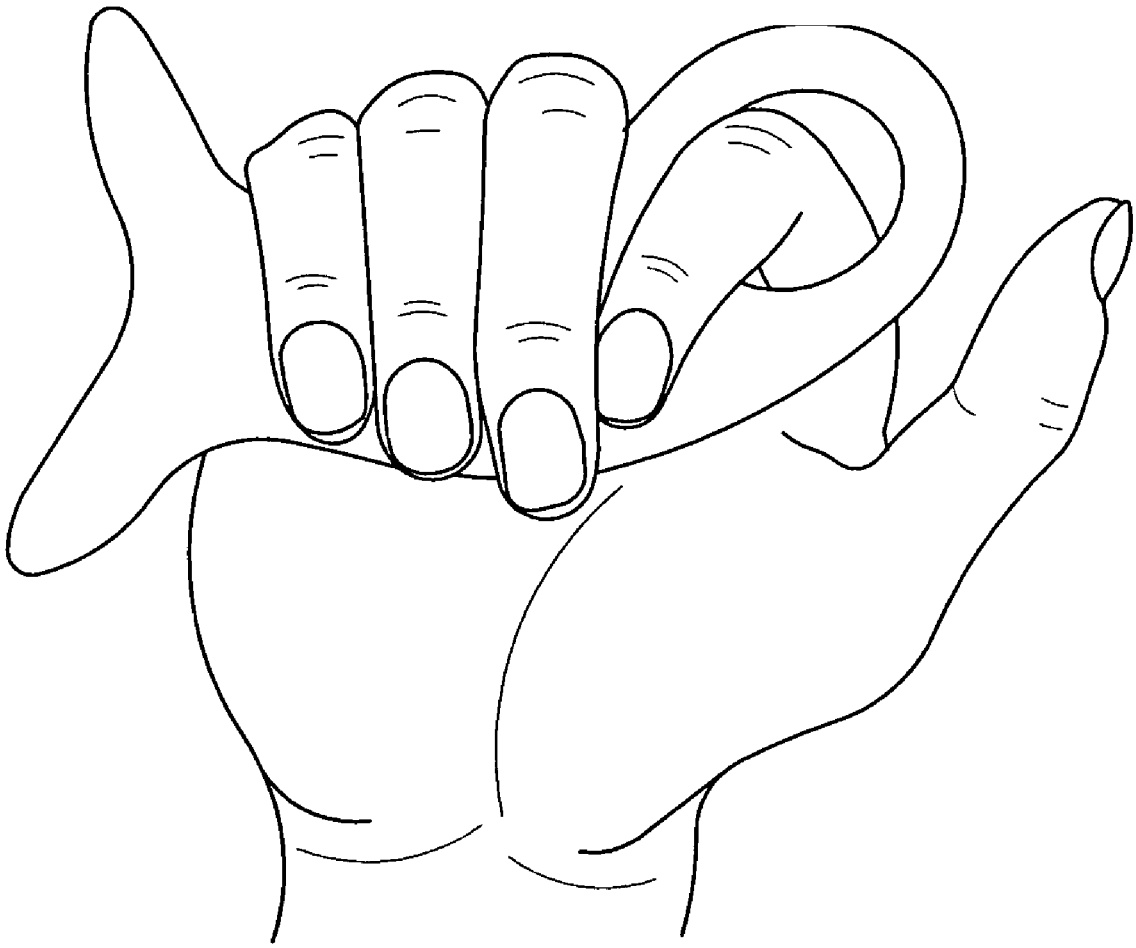
FIG. 5 is a view showing an embodiment of the defense device in the hand of a user.

With initial reference to FIG. 1, an embodiment of the personal defense device 10 is illustrated in a perspective view. The defense device 10 preferably comprises an elongated shaft 12 that is adapted for grasping thereof by a user's hand. Preferably, the defense device 10 comprises a proximal end 14, a distal end 16, a forward side 18, and a rearward side 20. In one embodiment, the rearward side 20 of the elongated shaft 12 comprises an arcuate edge 22, forming a palm-receiving surface 24. Preferably, the palm-receiving surface 24 is designed to fit in the arcuate face of the palm when the hand is closed (as illustrated in FIG. 5). The palm-receiving surface 24 may differ in curvature, shape, and size for various embodiments to accommodate different palm curvatures. In one embodiment, the palm-receiving surface 24 is convex. In other embodiments, the palm-receiving surface 24 may be shapes other than convex, such as straight, concave, straight and concave, concave and convex, straight and convex, etc.

As shown in FIG. 1, the elongated shaft 12 may comprise one or more arcuate open sided finger receiving recesses 26 on the forward side. In the illustrated embodiment, the elongated shaft 12 comprises three finger-receiving recesses 26, but the device 10 could have more or less. In another embodiment, the recesses 26 may be different shapes. For example, the recesses 26 could be square, rectangular, triangular, etc.

With continued reference to FIG. 1, the illustrated embodiment further comprises an opening 28 at the proximal end 14 of the elongated shaft 12. The opening 28 is sized and configured to accommodate a forefinger of a user when the user grasps the device 10. When the defense device 10 is used, the forefinger is placed through the opening 28, the remaining fingers are placed in the finger recesses 26, and the palm-receiving surface 24 rests on the palm of the hand (as shown in FIG. 5). The opening 28 provides greater security, comfort, and practical stability for the use. When the user grasps the defense device 10 and places the forefinger through the opening 28, it is difficult for the defense device 10 to be knocked out of the user's hand. Preferably, the opening 28 surrounds a portion of the forefinger when the finger is placed in the opening 28 and the fist is closed. While the opening 28 in the illustrated embodiment is cylindrical, the opening 28 may be any shape that accommodates the forefinger. For example, the opening 28 may be square, oval, elliptical, rectangular, triangular, etc.

Figure 2:
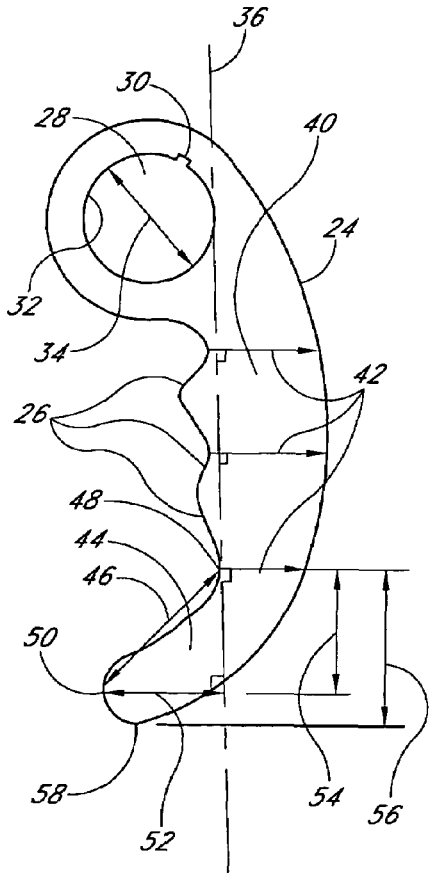
FIG. 2 is a plan view of one embodiment of the defense device.

In a further embodiment, the opening 28 is designed to accommodate a key ring. With reference to FIG. 2, in one embodiment, the opening 28 may further comprise a channel 30 on an inside surface 32 of the opening 28 to accommodate the key ring. While the illustrated embodiment shows a rectangular channel, the channel may vary in shape or depth. For example, the channel may be concave, triangular, etc.

In the illustrated embodiment of FIG. 2, the opening 28 is comprised of a cylinder with a diameter 34. The length of the diameter 34 may vary, depending upon the user. Preferably, the diameter 34 is sufficiently long to accommodate the user's forefinger. In one embodiment, the diameter 34 is about one inch. In other embodiments, the diameter 34 may vary from about ½ to 1½ inches. In yet further embodiments, the diameter 34 may vary significantly less than about ½ inch and significantly greater than about 1½ inches. An axis 36 of the device 10 is defined by a line that is tangent to both the rearward portion of the opening 28 and the distal-most recess 26.

With continued reference to FIG. 2, in one embodiment, the elongated shaft 12 between the recesses 26, the opening 28, and the palm-receiving surface 24 comprises a grip 40 of the defense device 10. In the illustrated embodiment, a device width 42 is defined by a length perpendicular to the axis 36 between the trough of the recesses 26 and the palm-receiving surface 24. The device width 42 may vary depending upon the size of the user's hand. In one embodiment, the device width 42 may be the same for each recess 26. In other embodiments, the device width 42 may be different for some or each recess 26. Preferably, the device width 42 is a length whereby the grip 40 will fit comfortably within the user's hand. In one embodiment, the device width 42 is about one inch. In further embodiments, the device width 42 may vary from about ½ to 2 inches. In yet further embodiments, the device width 42 may vary significantly less than about ½ and significantly greater than 2 inches. In one embodiment, the device width 42 decreases from the proximal end 14 to the distal end 16. For example, the first recess may be about ⅞ inch, the second recess may be about ¾ inch, and the third recess may be about ⅝ inch.

In some embodiments, the grip 40 is substantially the same texture or material as the rest of the defense device 10. In yet other embodiments, the surface of the grip 40 may be textured to increase the friction between the grip 40 and the palm of the hand by means known to those of ordinary skill in the art. In further embodiments, the grip 40 may be covered or wrapped with material that will increase the friction between the grip 40 and the palm. In another embodiment, the grip 40 may be made of different material than other parts of the defense device 10. In yet further embodiments, the grip 40 may be altered by other means known to those of ordinary skill in the art to increase the user's ability to hold and retain the defense device 10.

With reference to FIG. 2, in the illustrated embodiment, the elongated shaft 12 extends below the grip 40 at the distal end 16 to form one or more protrusions 44 that constitute impact elements of the defense device 10. In FIG. 2, a protrusion length 46 represents the distance from the distal-most recess trough point 48, a point in the distal-most recess where the device width 42 is a minimum, to a protrusion tip point 50 that is the farthest point on the protrusion 44 from the axis 36, measured by a protrusion width 52. The distance along the axis 36 from the distal-most recess trough point 48 to the protrusion tip point 50 is measured by a protrusion tip point height 54. Preferably, the protrusion width 52 is long enough to effectively hook an orifice or pressure point on an assailant or to effectively strike an assailant. In one embodiment, the protrusion length 46, the protrusion width 52, and the protrusion tip point height 54 form a right triangle. In another embodiment, the protrusion width 52 and protrusion tip point height 54 are the same length. In other embodiments, the protrusion width 52 and protrusion tip point height 54 are different lengths. In one embodiment, the protrusion tip point height 54 or protrusion width 52 may be about one inch. In other embodiments, the protrusion tip point height 54 or protrusion width 52 may range from about ½ to 3 inches. In yet further-embodiments, the protrusion tip point height 54 or protrusion width 52 may vary significantly less than about ½ inch and significantly greater than about 3 inches.

With continued reference to FIG. 2, a protrusion height 56 represents the distance from the distal-most recess trough point 48 to a distal-most protrusion point 58, measured perpendicularly to the axis 36. In one embodiment, the protrusion height 56 is about one inch. In other embodiments, the protrusion height 56 may range from about ½ to 3 inches. In yet further embodiments, the protrusion height 56 may vary significantly less than about ½ inch and significantly greater than about 3 inches.

In the illustrated embodiment of FIG. 2, the device 10 is shown with a protrusion 44. In one embodiment, when the device 10 is used, the forefinger is placed through the opening 18 and remaining fingers are placed in the finger-receiving recesses 26. The protrusion 44, constituting an impact element, extends distally and forward of a pinky finger of a user's hand when the device 10 is grasped by the user.

Figure 2A:
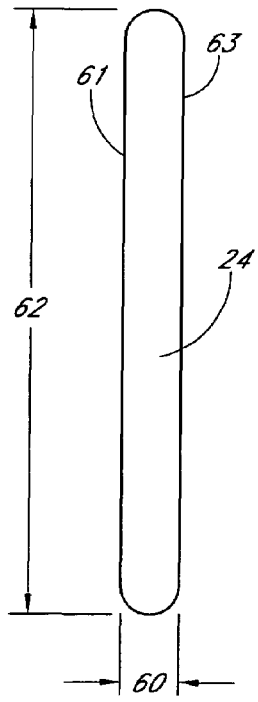
FIG. 2A is a side view of one embodiment of the device, viewing a palm receiving surface.

In FIG. 2A, the defense device 10 is shown by a side view perspective, viewing the palm-receiving surface 24. A depth 60 of the device 10 is measured between a top face 61 and a bottom face 63 of the device 10. Preferably, the top face 61 and the bottom face 63 are parallel to each other. The bottom and top faces 61, 63 may also comprise decorations or graphics. Preferably, the depth 60 is of such a length whereby the device 10 is held comfortably in the user's hand. In one embodiment, the depth 60 may be about ½ inch. In other embodiments, the depth 60 may range from about ¼ to 1½ inches. In further embodiments, the depth 60 may vary significantly less than about ¼ inch and significantly greater than about 1½ inches. In some embodiments, the depth 60 of the device 10 may be substantially uniform throughout the device 10, including the portion defining the opening 28. In other embodiments, the depth 60 may vary in the same device 10. For example, in one embodiment, the grip 40 may have a greater depth 60 than the proximal 14 and distal 16 portions of the device 10.

Continuing reference to FIG. 2A, a defense device length 62 is measured by the distance between the proximal-most point to the distal-most point of the defense device 10. In one embodiment, the defense device length 62 is about 5 inches. In other embodiments, the defense device length 62 may range from about 3½ to 6½ inches. In further embodiments, the defense device length 62 may vary significantly less than about 3½ inches and significantly greater than about 6½ inches. The length can be selected to accommodate a wide variety of user's hands.

Figure 3:
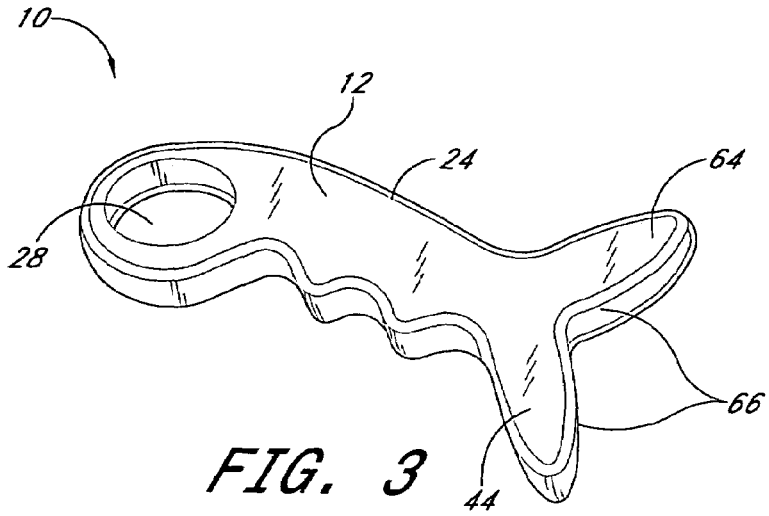
FIG. 3 is a perspective view of one embodiment of the defense device.

In FIG. 3, a further embodiment is illustrated that shows a rearward protrusion 64 that may extend in the direction of the palm-receiving surface 24. In this embodiment, the rearward protrusion 64 may operate as both an impact element and a lever against which the bottom of the user's hand may press for leverage while using the defense device 10. In some embodiments, the protrusions 44, 64 may form a striking surface 66 that will permit the user to strike an assailant with a downward thrusting motion. In some embodiments, the protrusions 44, 64 and the striking surface 66 constitute an impact element. In yet further embodiments, one or more protrusions (not shown) may extend from the defense device 10 near the opening 28. In one embodiment, there may be multiple protrusions 44, 64 that are the same length or shape. In other embodiments; the protrusions 44, 64 may vary in length and shape. For example, in various embodiments, the protrusions 44, 64 may be triangular, square, rectangular, oval, circular, etc. In FIG. 3, an embodiment is shown where the impact element constitutes a forward protrusion 44 and a rearward protrusion 64 that is a double fin-shape with blunt tips. In FIG. 2, an embodiment is shown where the impact element constitutes a forward protrusion 44 that is a single fin-shape with blunt tips.

Preferably, the protrusions 44, 64 and the striking surface 66 comprise round edges to prevent lethal injury and to comply with security regulations in many amusement parks, public buildings, and public transportation, particularly passenger aircraft. In one embodiment, the edges or corners of the device 10 are rounded or trimmed as illustrated by the rounded proximal 14 and distal 16 ends in FIG. 2A. The corners may be rounded or trimmed to form shapes such as a triangle, trapezoidal, etc. In another embodiment, some edges or corners may be rounded or trimmed while others are not. In yet another embodiment, the edges or corners are not rounded or trimmed.

Figure 4:
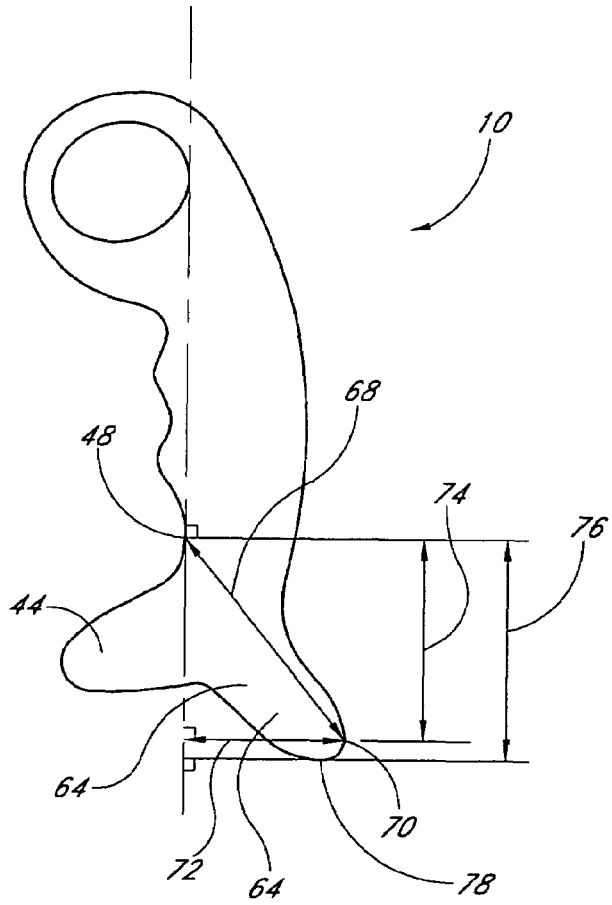
FIG. 4 is a plan view of one embodiment of the defense device.

With reference to FIG. 4, the defense device 10 is shown in a plan view. In the illustrated embodiment, a rearward protrusion 64 is shown. A rearward protrusion length 68 represents the distance from the distal-most recess trough point 48 to a rearward protrusion tip point 70 that is the farthest point on the rearward protrusion 64 from the axis 36, measured by a rearward protrusion width 72. The distance along the axis 36 from the distal-most recess trough point 48 to the rearward protrusion tip point 70 is measured by a rearward protrusion tip point height 74. In one embodiment, the rearward protrusion length 68, the rearward protrusion width 72, and the rearward protrusion tip point height 74 form a right triangle. In another embodiment, the rearward protrusion width 72 and rearward protrusion tip point height 74 are the same length. In other embodiments, the rearward protrusion width 72 and rearward protrusion tip point height 74 are different lengths' In one embodiment, the rearward protrusion tip point height 74 or rearward protrusion width 72 may be about one inch. In other embodiments, the rearward protrusion tip point height 74 or rearward protrusion width 72 may range from about ½ to 3½ inches. In yet further embodiments, the rearward protrusion tip point height 74 or rearward protrusion width 72 may vary significantly less than about ½ inch and significantly greater than about 3½ inches.

With continued reference to FIG. 4, a rearward protrusion height 76 represents the distance from a distal-most recess trough point 48 to a distal-most rearward protrusion point 78, measured perpendicularly to the axis 36. In one embodiment, the rearward protrusion height 76 is about 1½ inches. In other embodiments, the rearward protrusion height 76 may range from about ½ to 3 inches. In yet further embodiments, the rearward protrusion height 76 may vary significantly less than about ½ inch and significantly greater than about 3 inches:

The defense device 10 may be used to hook orifices or pressure points on the assailant, or it may also be used by striking the assailant with the protrusions 44, 64 or striking surface 66. One method of using the defense device comprises providing a defense device with an elongated shaft, the elongated shaft having a proximal end, a distal end, a forward side, and a rearward side; an opening on the proximal end that is sized and configured to accommodate placement of a forefinger of a user through the opening; a palm-receiving surface on the rearward side; a finger-receiving surface on the forward side; and a protrusion extending distally of the device. The method further comprises inserting a forefinger of the user through the opening, placing the palm-receiving surface on the palm of the user, and placing the fingers on the finger-receiving surface. When the device is used in this manner, the protrusion extends distally of the user's hand. The device can be used to strike an assailant by a thrusting motion, such as forward, rearward, upward, downward, etc. The device may also be used to hook an assailant's orifice or pressure point, such as the mouth, eye, ear, etc. It has been determined that the impact of the defense device 10 will cause disabling non-lethal force or pain to various parts of the body, particularly parts without significant amounts of tissue between the skin and bone. For example, the defense device 10 may apply disabling non-lethal force or pain to the hand, wrist, elbow, foot, ankle, shin, knee, collar, shoulder, jaw, cheek, or skull. The disabling force or pain can be applied while reducing the possibility of lethal injury.

In one embodiment, the defense device 10 is constructed from wood. Suitable wood may be relatively dense wood, for example maple or hickory. The wood may also be relatively soft and lightweight, such as pine and poplar. Any type of wood falling within or beyond these examples' range of density may also be used. In other embodiments, the defense device 10 may be made of materials other than wood that are known by those of ordinary skill in the art. For example, other materials may include plastics, composites, ceramics, metals, etc. In other embodiments, the defense device 10 may comprise combinations of such materials. As shown in FIG. 1 and FIG. 3, in the illustrated embodiments, the elongated shaft 12 is fabricated of one piece of material. In other embodiments, the elongated shaft 12 may comprise multiple pieces of the same material or multiple pieces of different materials.

Although this defense device 10 has been disclosed in the context of certain preferred embodiments and examples, it will be understood by those skilled in the art that the defense device 10 extends beyond the specifically disclosed embodiments to other alternative embodiments and/or uses of the defense device 10 and obvious modifications and equivalents thereof. In addition, while a number of variations of the defense device 10 have been shown and described in detail, other modifications, which are within the scope of this device 10, will be readily apparent to those of skill in the art based upon this disclosure. It is also contemplated that various combinations or subcombinations of the specific features and aspects of the embodiments may be made and still fall within the scope of the device 10. Accordingly, it should be understood that various features and aspects of the disclosed embodiments can be combined with or substituted for one another in order to form varying modes of the disclosed defense device 10. Thus, it is intended that the scope of the defense device 10 herein disclosed should not be limited by the particular disclosed embodiments described above, but should be determined only by a fair reading of the claims that follow.

What is claimed is:

1. A personal defense device comprising:

an elongated shaft, the shaft having a proximal and distal end and a forward and rearward side;

the proximal end further comprising an opening, the opening integral with the elongated shaft and sized and configured to accommodate placement of a forefinger of a user through the opening;

the forward side comprising a generally concave surface;

the forward side further comprising a plurality of open-sided recesses integrally formed with the elongated shaft and configured to receive fingers of the user;

the rearward side comprising a generally convex surface; and the distal end further comprising a protrusion extending at least distally and forward from a distal-most recess;

wherein the device is capable of receiving the forefinger through the opening with other fingers placed in the recesses such that they are uncovered on one side and such that the protrusion forms an impact element extending at least distally and forward of a pinky finger of the user;

wherein the elongated shaft of the personal defense device that comprises the proximal end, distal end, forward side and rearward side is fabricated from a single piece of material that comprises blunt, rounded edges substantially entirely thereabout; and wherein the proximal end of the elongated shaft that comprises the opening extends proximally and forward from a proximal-most recess on the forward side of the elongated shaft, such that the proximal end comprising the opening and the protrusion at the distal end of the elongated shaft are positioned opposite to one another at locations forward of the open-sided recesses on the forward side of the elongated shaft.

2. The device of claim 1, wherein the opening is cylindrical with a diameter of about ½ inch to 1½ inches.

3. The device of claim 1, further comprising a channel on an inside surface of the opening to accommodate a key ring.

4. The device of claim 3, wherein the channel is rectangular.

5. The device of claim 1, wherein the shaft has a device depth of about ¼ inch to 1½ inches.

6. The device of claim 1, wherein the shaft has a substantially uniform device depth from the proximal end to the distal end.

7. The device of claim 1, wherein the shaft has a device length of about 3½ inches to 6½ inches.

8. The device of claim 1, wherein the recesses are curved.

9. The device of claim 1, comprising three recesses.

10. The device of claim 1, further comprising a grip between the forward side and rearward side having a width of about ½ inch to 2 inches.

11. The device of claim 1, comprising a plurality of protrusions.

12. The device of claim 1, further comprising:

an axis formed by a line tangent to both the rearward portion of the opening and the distal-most recess;

a distal-most recess trough point, the distal-most recess trough point being the position in the distal-most recess where a device width is at a minimum;

a protrusion tip point, the protrusion tip point being located at the farthest point on the protrusion from the axis;

a protrusion width, the protrusion width being the perpendicular distance from the axis to the protrusion tip point;

a protrusion tip point height, the protrusion tip point height being the distance along the axis from the distal-most recess trough point to the protrusion width measurement;

a distal-most protrusion point, the distal-most protrusion point being the distal-most point on the protrusion when measured perpendicularly from the axis; and a protrusion height, the protrusion height being the distance along the axis to the perpendicular measurement of the distal-most protrusion point.

13. The device of claim 12, wherein the protrusion width and the protrusion tip point height are about the same length.

14. The device of claim 12, wherein the protrusion width is about ½ inch to 3 inches.

15. The device of claim 12, wherein the protrusion tip point height is about ½ inch to 3 inches.

16. The device of claim 12, wherein the protrusion height is about ½ inch to 3 inches.

17. The device of claim 1, further comprising:

an axis formed by a line tangent to both a rearward portion of the opening and a distal-most recess;

a rearward protrusion;

a distal-most recess trough point, the distal-most recess trough point being the position in the distal-most recess where a device width is at a minimum;

a rearward protrusion tip point, the rearward protrusion tip point being located at the farthest point on the rearward protrusion from the axis;

a rearward protrusion width, the rearward protrusion width being the perpendicular distance from the axis to the rearward protrusion tip point;

a rearward protrusion tip point height, the rearward protrusion tip point height being the distance along the axis from the distal-most recess trough point to the rearward protrusion width measurement;

a rearward distal-most protrusion point, the rearward distal-most protrusion point being the distal-most point on the rearward protrusion when measured perpendicularly from the axis; and a rearward protrusion height, the rearward protrusion height being the distance along the axis to the perpendicular measurement of the rearward distal-most protrusion point.

18. The device of claim 17, wherein the rearward protrusion width and the rearward protrusion tip point height are about the same length.

19. The device of claim 17, wherein the rearward protrusion width is about ½ inch to 3½ inches.

20. The device of claim 17, wherein the rearward protrusion tip point height is about ½ inch to 3½ inches.

21. The device of claim 17, wherein the rearward protrusion height is about/1;2 inch to 3 inches.

22. The device of claim 1, further comprising round edges.

23. The device of claim 1, wherein the device is constructed of wood.

24. A personal defense device comprising:

an elongated shaft, the shaft having a proximal and distal end and a forward finger-receiving side comprising a plurality of open-sided recesses and a rearward palm-receiving side;

the proximal end further comprising an opening, the opening sized and configured to accommodate placement of a forefinger of a user through the opening; and the distal end further comprising a protrusion;

wherein the device is capable of receiving the forefinger through the opening with other fingers placed in the recesses on the finger receiving side and uncovered on the opposite side, and the protrusion forms an impact element extending at least distally from the user's hand, and wherein the elongated shaft of the personal defense device that comprises the proximal end, distal end, forward finger-receiving side and rearward palm-receiving side is fabricated from a single piece of material that comprises blunt, rounded edges substantially entirely thereabout; and wherein the proximal end of the elongated shaft that comprises the opening extends proximally and forward from a proximal-most recess on the forward finger-receiving side of the elongated shaft, and wherein the protrusion at the distal end of the elongated shaft extends distally and forward from a distal-most recess on the forward finger-receiving side of the elongated shaft, such that the proximal end comprising the opening and the protrusion at the distal end of the elongated shaft are positioned opposite to one another at locations forward of the open-sided recesses on the forward finger-receiving side of the elongated shaft.

25. The device of claim 24, wherein the forward side comprises a generally concave surface.

26. The device of claim 24, comprising three recesses.

27. The device of claim 24, wherein the rearward side comprising a generally convex surface.

28. The device of claim 24, wherein the opening is cylindrical.

29. The device of claim 24, further comprising a channel on an inside surface of the opening to accommodate a key ring.

30. The device of claim 24, wherein the protrusion extends forward from the user's hand when in use.

31. The device of claim 24, wherein the protrusion extends rearward from the user's hand when in use.

32. The device of claim 24, wherein the protrusion is a single fin-shape with blunt tips.

33. The personal defense device of claim 1, wherein the opening comprises a completely enclosed opening.

34. The personal defense device of claim 1, further comprising a key ring retention opening configured to receive a key ring.

35. The personal defense device of claim 24, wherein the opening comprises a completely enclosed opening.

36. The personal defense device of claim 24, further comprising a key ring retention opening configured to receive a key ring.

* * * * *

UNITED STATES PATENT AND TRADEMARK OFFICE

CERTIFICATE OF CORRECTION

PATENT NO. : 7,503,829 B2
APPLICATION NO. : 10/695683
DATED : March 17, 2009
INVENTOR(S) : Charles F. Cory It is certified that error appears in the above-identified patent and that said Letters Patent is hereby corrected as shown below:

At Column 4, Line 5, change “further-embodiments,” to --further embodiments,--.

At Column 5, Line 36, change “lengths’” to --lengths.--.

At Column 5, Line 53, change “inches:” to --inches.--.

At Column 8, Line 34, in Claim 21, change “/1;2 inch” to --1/2 inch--.

Signed and Sealed this

Fourth Day of August, 2009

John Doll

JOHN DOLL
*Acting Director of the United States Patent and Trademark Office*